US009064660B2

(12) United States Patent
Lam

(10) Patent No.: US 9,064,660 B2
(45) Date of Patent: Jun. 23, 2015

(54) REMOTE CONTROLLED INTERACTIVE POWER SWITCH

(75) Inventor: Sheir Chun Lam, Hong Kong (CN)

(73) Assignee: TECHNOLOGY LOGIC INTERNATIONAL LIMITED, Sheung Wan (HK)

( * ) Notice: Subject to any disclaimer, the term of this patent is extended or adjusted under 35 U.S.C. 154(b) by 424 days.

(21) Appl. No.: 13/699,746

(22) PCT Filed: Aug. 16, 2012

(86) PCT No.: PCT/CN2012/080260
§ 371 (c)(1),
(2), (4) Date: Nov. 26, 2012

(87) PCT Pub. No.: WO2013/139107
PCT Pub. Date: Sep. 26, 2013

(65) Prior Publication Data

US 2013/0249320 A1 Sep. 26, 2013

(30) Foreign Application Priority Data

Mar. 22, 2012 (CN) ..... 2012 1 0078290

(51) Int. Cl.
*H01H 35/00* (2006.01)
*H01H 47/00* (2006.01)
*H01H 47/22* (2006.01)
*H01H 50/32* (2006.01)

(52) U.S. Cl.
CPC ..... *H01H 47/00* (2013.01); *Y10T 307/944* (2015.04); *H01H 47/002* (2013.01); *H01H 47/226* (2013.01); *H01H 50/32* (2013.01)

(58) Field of Classification Search
USPC ..... 307/116
See application file for complete search history.

(56) References Cited

U.S. PATENT DOCUMENTS

| | | | | |
|---|---|---|---|---|
| 4,858,056 | A * | 8/1989 | Russell | 361/98 |
| 5,307,058 | A * | 4/1994 | Tokizane et al. | 340/3.21 |
| 6,163,444 | A * | 12/2000 | Lam | 361/42 |
| 6,388,858 | B1 * | 5/2002 | Simms et al. | 361/115 |
| 8,421,588 | B1 * | 4/2013 | Ross et al. | 340/5.1 |

* cited by examiner

*Primary Examiner* — Stephen W Jackson
(74) *Attorney, Agent, or Firm* — Andrew W. Chu; Craft Chu PLLC

(57) ABSTRACT

A remote controlled interactive power switch includes a first coil for controlling a switch contact to be closed by suction, a self-locked device for locking the switch contact to keep conducting state by mechanical self-locking, a second coil for controlling the self-locked device to be disengaged and a power supply control circuit. The power supply control circuit is connected with an interactive control module which includes a remote controlled interactive connecting unit, an interactive monitoring unit, a switch-on signal producing unit and a turn-off signal producing unit. The present invention can simplify the complex control circuit and thoroughly resolve the technical requirements of the power switch with high make-break capacity. Additionally, the present invention produces consumption only when starting the on-off switch, and after starting and under normal operation, the pulse magnetic energy coil keeps an inactivity state, no consumption, no heat and no noise.

11 Claims, 4 Drawing Sheets

REMOTE CONTROLLED INTERACTIVE POWER SWITCH

FIELD OF THE INVENTION

The present invention relates to a power switch, and more particularly to a remote controlled interactive power switch.

BACKGROUND OF THE INVENTION

A power switch with high make-break capacity generally takes the spring energy as driving force by using manual operating device to compress the spring, so as to meet all the high standard technical requirements. If takes general electromagnetic energy as a powerplant of the switch, due to the insufficient explosive force produced by the electromagnetic energy and the affect of residual magnetism (magnetic hysteresis), it can not meet the technical requirement of high speed make-break capacity, thereby bringing some defects to be resolved, such as the contact junction easy to be burnt by electric arc, big power consumption, producing a lot of heat and producing noise when working. Meanwhile, the power switch which is usually applied in power distribution network has big switching current, thus, when fault current appears, it is very dangerous to operate the switch by hand. The best way to use it safely is uses a remote control or automatic system to control. At present, converting the manual operating device of circuit breaker into remote control or automatic system control is complex and high cost, thus it is hard to be applied to remote control or automatic system equipment.

Additionally, general electric engineering equipment usually uses an extra mechanical interlocking device as interactive safety insurance, but these mechanical interlocking devices have huge volume and complex circuit.

SUMMARY OF THE INVENTION

To overcome the defects that the switching device taking the electromagnetic energy as driving force is easy to produce arc to burn the contact junction, has huge power consumption, heating and noise when working, and the mechanical interlinking device of the related electrical equipment has huge volume and complex circuit. One object of the present invention is utilizing the powerful explosive force (be equal to the spring driving force energy used by a breaker) produced by the pulse magnetic energy to absorb a forceful spring mechanical contact at high speed, before the instantaneous magnetic energy disappeared, locking the contact to be conducting state by mechanical self-locking until the mechanical self-locking circuit instructed to be release by an external signal. When releasing, the forceful spring rebound to drive the contact open at high speed and return an original state, the high make-break capacity make the collapsing force of the electric arc to be lowest.

During the whole process, except take charge of converting the pulse current into pulse magnetic field energy as driving force of the on-off switch, the present invention is interactively connected with a related remote controlled interactive power switch via photo-electric coupling circuits and remote control devices to produce an effect that they can monitor and control each other, thereby simplifying the complex control circuit, thoroughly resolving the technical requirements of the power switch with high make-break capacity and achieving a purpose that it can popularly be applied to the power distribution network as a remote control or an automatic system control switch device.

Another characteristic of the present invention is that consumption is produced only when starting on-off switch. After starting and under normal operation, pulse magnetic energy coil keeps an inactivity state, no consumption, no heat and no noise, thus, the pulse magnetic energy coil has very small volume to save many metal raw material and achieve highest benefit of environmental protection and energy conservation.

The object of the present invention is achieved by the following technical measures: a remote controlled interactive power switch, includes a first coil for controlling a switch contact to be closed by suction, a self-locked device for locking the switch contact to keep conducting state by mechanical self-locking, a second coil for controlling the self-locked device to be disengaged and a power supply control circuit which is connected with an interactive control module, the interactive control module comprising a remote controlled interactive connecting unit, an interactive monitoring unit, a switch-on signal producing unit and a turn-off signal producing unit, wherein:

The remote controlled interactive connecting unit includes a remote controlled receiving interface and an interactive monitoring interface; the remote controlled receiving interface is provided for receiving an external remote controlled switch-on instruction or a turn-off instruction and outputting it to the interactive monitoring unit via a photo-electric coupling circuit; the interactive monitoring interface is provided for making a cross connection between the interactive monitoring unit of the present power switch and an interactive monitoring interface of a related remote controlled interactive power switch;

The interactive monitoring unit is provided for outputting a compulsive turn-off instruction to an interactive monitoring unit of the related remote controlled interactive power switch after receiving the switch-on instruction produced by the remote controlled receiving interface and instructing the turn-off signal producing unit to output a turn-off signal after receiving a compulsive turn-off instruction produced by the interactive monitoring unit of the related remote controlled interactive power switch;

The switch-on signal producing unit is provided for receiving a switch-on instruction and outputting a switch-on signal when the interactive monitoring unit affirms that no compulsive turn-off instruction is existing;

The turn-off signal producing unit is provided for emitting a turn-off signal in real time when receiving the turn-off instruction or compulsive turn-off instruction.

In a preferred way, the remote controlled receiving interface is connected with a switch-on instruction detecting unit via a photo-electric coupling circuit and outputs the switch-on instruction; the remote controlled receiving interface is connected with the turn-off instruction detecting unit via a photo-electric coupling circuit and outputs the turn-off instruction; the interactive monitoring unit is connected with the interactive monitoring interface via a photo-electric coupling circuit and receives the compulsive turn-off instruction.

In a preferred way for protecting the switch, a delay circuit unit is provided between the switch-on instruction detecting unit and switch-on signal producing unit for outputting signal to the switch-on signal producing unit delayedly.

In a preferred way for protecting the switch, a compulsive turn-off instruction output interface of the interactive monitoring unit is connected with a switch which can be switched on with the switch contact.

Concretely, the power supply control circuit further includes:

An impulse direct-current source module, which is provided for converting alternating current source into impulse direct-current by a bridge rectifier and then outputting to the first coil, second coil and other modules which need the power supply;

A first coil power supply control module, which is provided for producing a zero potential impulse wave according to the impulse direct-current voltage produced by the impulse direct-current source module, forming a monopulse switch-on signal when the switch-on signal is triggered at the next closest zero potential impulse, extracting pulsating current by the monopulse switch-on signal from the impulse direct-current source and outputting to the first coil to make the first coil produce a pulsed magnet field;

A second coil power supply control module, which is triggered by the turn-off signal to supply a pulse current for the second coil.

More concretely, the first coil power supply control module includes:

A zero potential impulse wave producing unit, which is provided for converting the zero potential of the entered impulse direct-current into high potential pulse signal by an electronic switching tube;

A monopulse switch-on instruction triggering unit, which is provided for outputting a monopulse switch-on signal when the switch-on signal is triggered at the next closest zero potential impulse;

A current producing unit, which is provided for supplying an access of the first coil and impulse direct-current source module triggered by the monopulse switch-on signal.

In a preferred concrete way, an outage automatic turn-off unit is connected between the second coil power supply control module and impulse direct-current source module for outputting a turn-off signal when the alternating current source is cut off.

In a preferred concrete way, the switch-on instruction detecting unit is further connected with a button switch for producing a switch-on instruction when the button switch is closed.

The present invention has both high make-break capacity and remote control function. It can simplify the complex control circuit of previous power grid project, largely save the peripheral auxiliary appliance and reduce equipment cost. Further more, the present invention makes a cross connection with its related remote controlled interactive power supply switch to achieve an effect that it can monitor and control each other, thereby achieving simplification of control circuit without using mechanical interconnection control. The application range of the present invention covers two different kind of power engineering device including power grid project and automatic electrical engineering; it also can be applied for intelligent household electric device.

The advantage of the present invention further includes that use the pulse magnetic energy as driving force. When working, the magnet coil will produce consumption only when the contact makes an open or close action; after the action stopping, the magnet coil will be inactivity state, no consumption, no heating and no noise, it is safe and durable. Because the magnet coil is in inactivity state at most of time, the volume of pulse magnet coil is ⅔ smaller than that of the traditional magnet coil, thereby saving largely metal raw material and achieving good benefit of environmental protection and energy conservation.

DETAILED DESCRIPTION OF ILLUSTRATED EMBODIMENTS

The further detailed descriptions of the present invention combining the embodiments and accompanying drawings are provided as follows.

Figure 1:
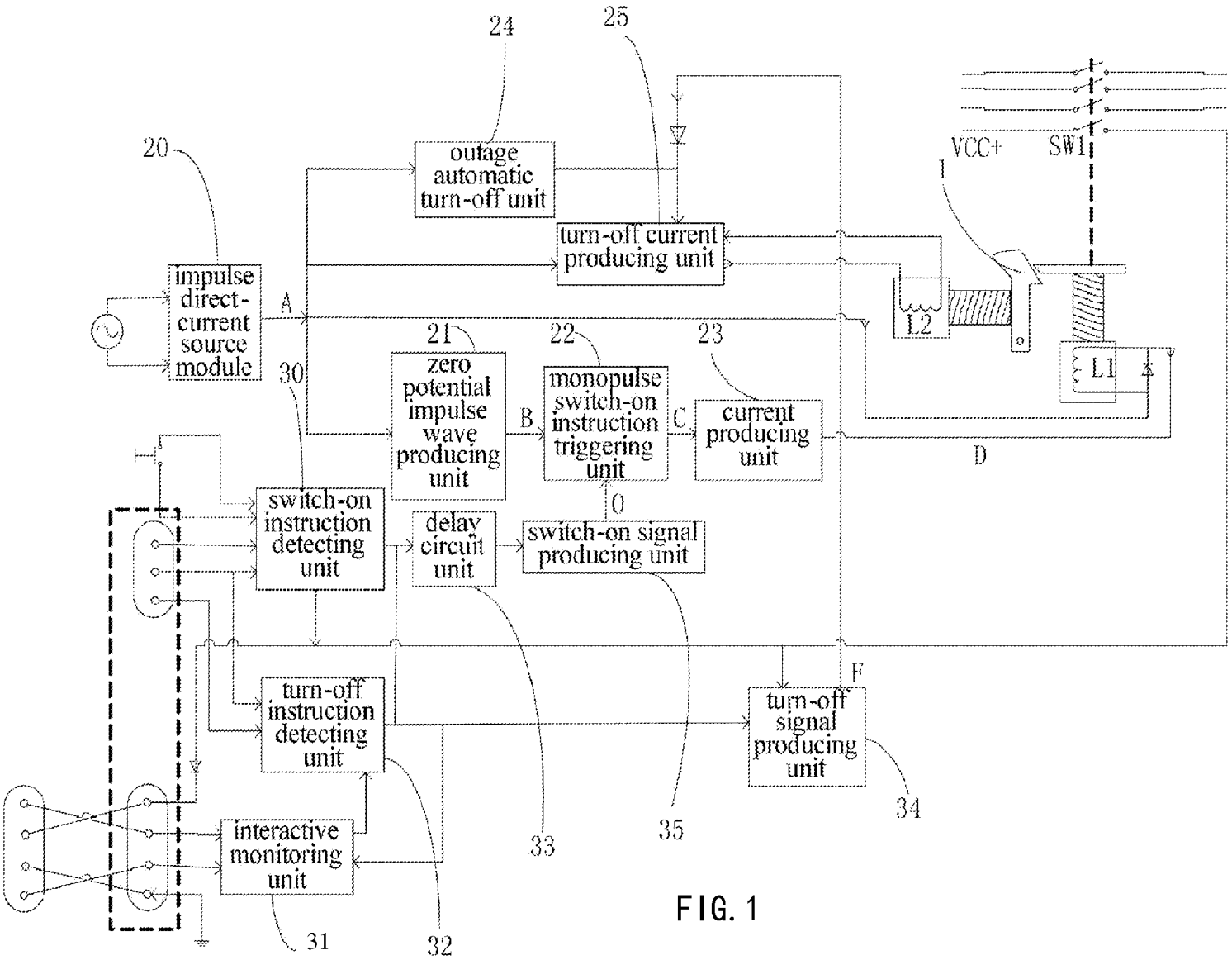
FIG. 1 is a structure schematic diagram of the present invention.

A remote controlled interactive power switch, as shown in FIG. 1, includes a first coil L1 for controlling a mechanical contact of a forceful spring to be sucked down at high speed. Before the instantaneous magnetic energy disappeared, use a self-locked device 1 to lock by itself for keeping the contact to be conducting state until a second coil L2 is instructed by an external instruction to be conductive so as to make the mechanical self-locked device 1 release, when releasing, the forceful spring rebound to drive the contact open at high speed and recover original state. A power supply control circuit is provided for supplying power to the first coil L1 and second coil L2. The power supply control circuit includes:

An impulse direct-current source module 20, is used for converting alternating current source into impulse direct-current by a bridge rectifier and then outputting to the first coil L1, second coil L2 and other modules which need the power supply;

A first coil power supply control module, which includes a zero potential impulse wave producing unit 21, a monopulse switch-on instruction triggering unit 22 and a pulse current producing unit 23, is provided for producing a zero potential impulse wave B according to the impulse direct-current signal produced by the impulse direct-current source module 20, forming a monopulse switch-on signal C when a switch-on signal O is triggered at the next closest zero potential impulse, extracting a pulsating current D from the impulse direct-current source 20 by the monopulse switch-on signal C and outputting to the first coil L1 to make the first coil L1 produce a pulsed magnet field;

A second coil power supply control module, which includes an outage automatic turn-off unit 24 connected with the first coil power supply control module and a turn-off current producing unit 25, is triggered by a turn-off signal F outputted by the outage automatic turn-off unit 24 or interactive control module to supply a pulse current for the second coil by the turn-off current producing unit 25.

A remote controlled interactive connecting unit 40 includes a remote controlled receiving interface J1A and an interactive monitoring interface J2A. The remote controlled receiving interface J1A receives an external remote controlled switch-on instruction, connects to a switch-on instruction detecting unit 30 via a photo-electric coupling circuit PT1 and outputs a switch-on instruction; the remote controlled receiving interface J1A receives an external remote controlled turn-off instruction, connects to a turn-off instruction detecting unit 34 via a photo-electric coupling circuit PT3 and outputs a turn-off instruction. The interactive monitoring interface J2A is used for making a cross connection between the interactive monitoring unit 31 of the present power switch and an interactive monitoring interface J2B of a related remote controlled interactive power switch, connects with the interactive monitoring interface J2A via a photo-electric coupling circuit PT2 and receives a compulsive turn-off instruction. The compulsive turn-off instruction output interface of the interactive monitoring unit J2A connects a switch SW1 which can be switched on with the switch contact.

An interactive control module includes a remote controlled interactive connecting unit 40, a switch-on instruction detecting unit 30, a button switch B1 connected to the switch-on instruction detecting unit 30, a turn-off instruction detecting unit 32, an interactive monitoring unit 31, a delay circuit unit 33, a switch-on signal producing unit 35 and a turn-off signal producing unit 34. The remote controlled receiving interface J1A of the remote controlled interactive connecting unit 40 outputs a switch-on signal O or turn-off signal F after receiving a switch-on or turn-off instruction, and the interactive monitoring unit 31 is provided for connecting with the interactive monitoring interface J2B of the interactive control module of the related remote controlled interactive power switch via the interactive monitoring interface J2A of the remote controlled interactive connecting unit 40, and outputs a compulsive turn-off signal to other related remote controlled interactive power switch while the switch-on signal O is produced.

Figure 2:
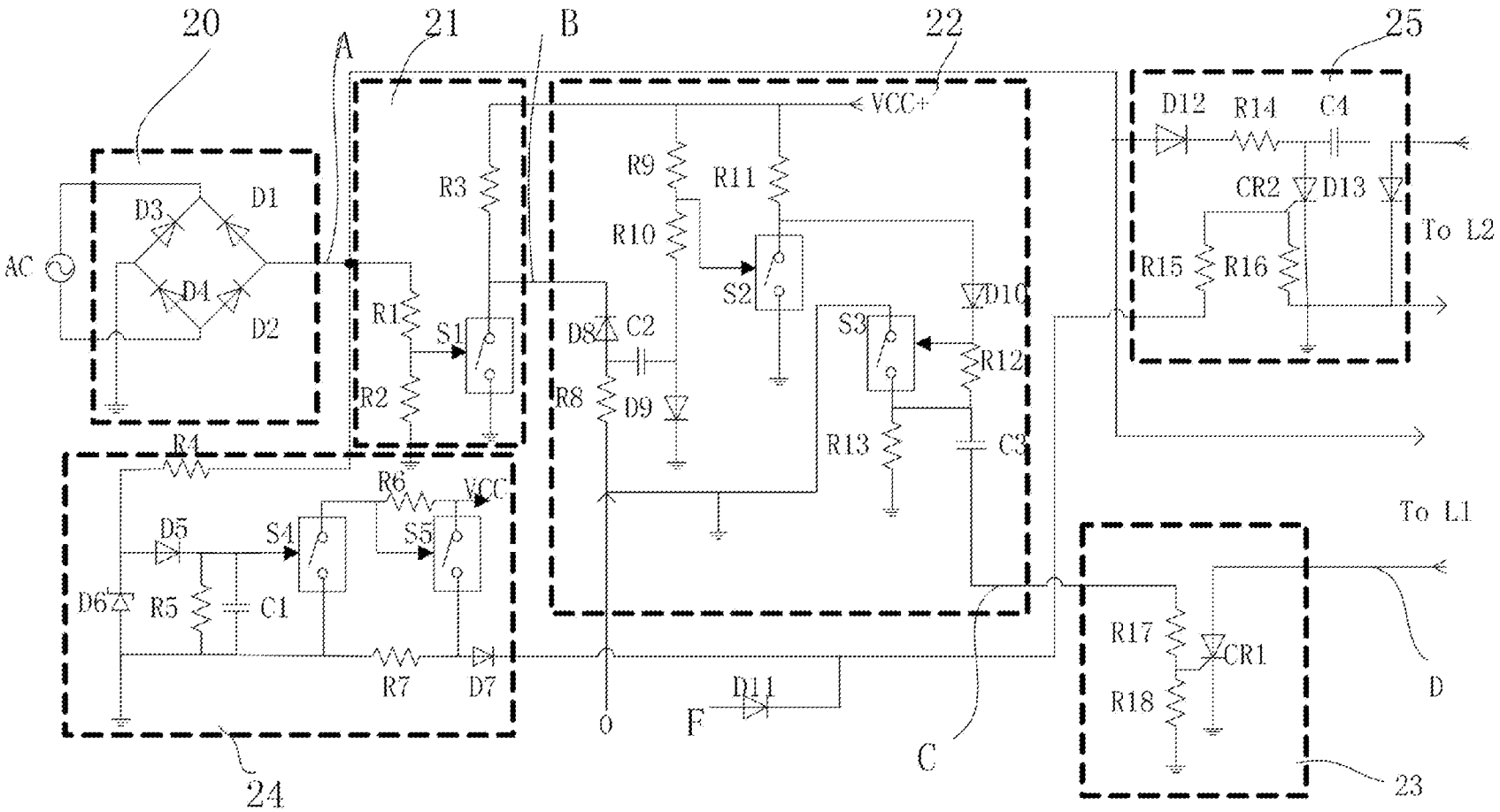
FIG. 2 is a circuit schematic diagram illustrating an impulse direct-current source module, first coil power supply control module and a second coil power supply control module of the present invention.

As shown in FIG. 2, the impulse direct-current source module 20 is a bridge rectifier circuit, which is composed of four diodes D1, D2, D3 and D4, and used for converting a alternating current power supply connected with the input end into impulse direct current signal A. One output end of the impulse direct-current source module 20 is connected to the first coil L1 for supplying pulse current to the first coil L1 so as to convert electrical energy into magnetic energy; another output end is connected to second coil supply power control module 25; further another output end is connected to the zero potential impulse wave producing unit 21; and the last output end is connected to the outage automatic turn-off unit 24.

The zero potential impulse wave producing unit 21 is an antiphase logic switching circuit, which is composed of three resistances R1, R2, R3 and one electronic switching tube S1, and used for converting the zero potential voltage of the entering impulse direct current signal A into zero potential pulse wave B and then outputting to the monopulse switch-on instruction triggering unit 22.

Figure 3:
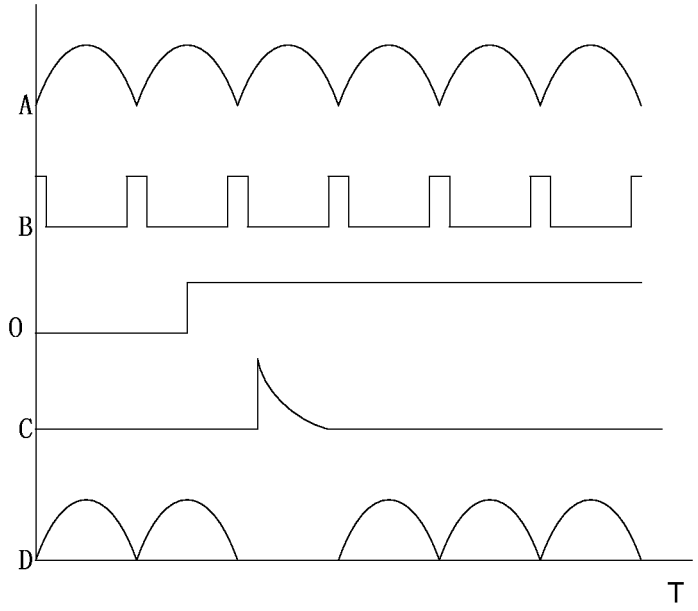
FIG. 3 are voltage oscillograms of point A, point B, point O, point C and point D of the circuit shown in FIG. 2.

As shown in FIG. 2 and FIG. 3, the monopulse switch-on instruction triggering unit 22, composed of six resistances R8, R9, R10, R11, R12, R13, three diodes D8, D9, D10, two capacitors C2, C3 and two electronic switching tubes S2, S3, is used for taking the zero potential pulse signal as time coordinate, providing a pulse voltage C produced by the switch-on signal O and zero potential pulse wave B. When the switch-on signal O (high potential) entering, the current charges the capacitor C2 via the resistance R8, if the zero potential pulse signal is in a low potential state, charging current flows to ground via the diode D8 and is shorted out, thus it can not charges the capacitor C2, until the zero potential pulse signal B turns to high potential, the current turns to charge the capacitor C2. When the zero potential pulse signal B turns to low potential again, the capacitor C2 discharges to the ground via the diode D8 to make the diode D9 produce a negative voltage, thereby the electronic switching tube S2 turns to be an open circuit and outputs a high potential voltage to the diode D10, so as to trigger the electronic switching tube S3 to be switched on. The high potential voltage of the switch-on signal O flows through the electronic switching tube S3, its one end flows through the resistance R12 to make the electronic switching tube S3 be locked by itself, and its the other end charges the capacitor C3 to produce the monopulse voltage C to trigger the pulse current producing unit 23, thereby outputting a DC pulsating current D to the first coil L1, so as to control the first coil L1 to suck down the switch contact and the switch SW1 to be switched on, and lock the switch contact to keep a switch-on state by the self-locked device.

The pulse current producing unit 23 is composed of two resistances R17, R18 and one electronic switching tube CR1. When the entering monopulse voltage C flows through the resistances R17 and R18 and triggers the electronic switching tube CR1 to make the electronic switching tube CR1 be switched on immediately, so as to make one end of the first coil L1 which is connected with the electronic switching tube CR1 be shorted out. The other output end of the first coil L1 which is connected with the impulse direct-current source module 20 outputs a DC pulsating current to the first coil L1, so as to control the first coil L1 to suck down the switch contact to be switched on and lock the switch contact to keep a switch-on state.

The outage automatic turn-off unit 24 is an antiphase logic switching circuit composed of three resistances R4, R5, R6, a capacitor C1, a diode D5, a voltage-regulator diode D6 and an electronic switching tube S4. Make the entering impulse direct current flow through the resistance R4, diode D5 and diode D6 to charge the capacitor C1, at the same time, make the electronic switching tube S4 output low potential in conducting state. When the external alternating current power supply suddenly disrupts, no impulse DC voltage to supply, the capacitor C1 discharges to the resistance R5 slowly, until the open circuit of the electronic switching tube S4 turns state, outputs a high potential voltage to make the electronic switching tube S5 be switched on, the voltage VCC flows through the electronic switching tube S5 and diode D7, and outputs a turn-off signal to the turn-off current producing unit 25.

The turn-off current producing unit 25 is a return circuit composed of two diodes D12, D13, resistance R14, capacitor C4 and the entering impulse DC. The impulse DC firstly charges the capacitor C4, the negative electrode of the capacitor C4 connects with the second coil L2, the positive electrode of the capacitor C4 connects with the electronic switching tube CR2. When a turn-off signal F inputs, flows through the resistance R15, R16 to trigger the electronic switching tube CR2 switch on, the capacitor C4 discharges to the second coil L2 to produce a powerful magnetic filed, then control the self-locked device 1 disengaged and make the contact junction open.

Figure 4:
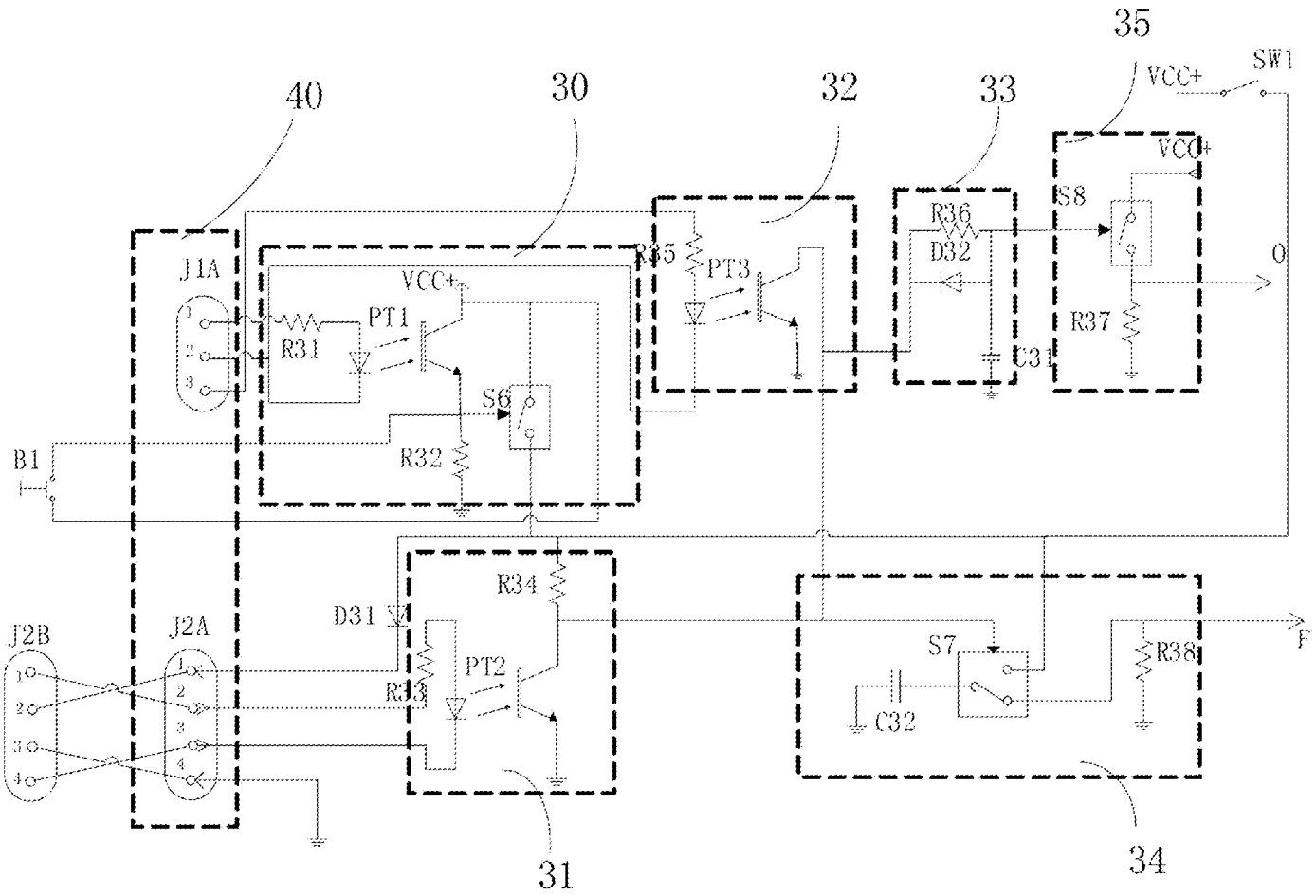
FIG. 4 is a circuit schematic diagram illustrating an interactive control module of the present invention.

As shown in FIG. 4, the switch-on instruction detecting unit 30 is composed of a photo-electric coupling circuit PT1, two resistances R31, R32 and an electronic switching tube S6. When a high potential of switch-on signal enters the first and second pins of the remote control socket J1 and is detected out from the photo-electric coupling circuit PT1 to switch on the electronic switching tube S6, outputs a high potential voltage signal, meanwhile, outputs to communicate with other related interactive switch via the first and fourth pins of the interactive socket J2A, and its other end outputs to the interactive monitoring circuit unit 31.

The interactive monitoring circuit unit 31, composed of two resistances R33, R34 and a photo-electric coupling PT2, utilizes the photo-electric coupling PT2 to monitor the dynamic of the signal which is sent to the second and third pins of the interactive socket J2A by the other related interactive switch, thereby determining the working dynamic of the present machine including switch-on or turn-off action.

The turn-off instruction detecting unit 32 is composed of a resistance R35 and a photo-electric coupling PT3. When the second and third pins of the remote control socket J1 has a high potential of the turn-off instruction inputting, the photo-electric coupling PT3 is switched on to control the turn-off signal producing unit 34 to work.

The turn-off signal producing unit 34 is composed of a capacitor C32, an electronic switching tube S7 and a resistance R38. When the switch is in standby state, the capacitor C32 connects with the resistance R38 via the electronic switching tube S7. When the interactive monitoring circuit unit 31 sends out a switch-on instruction to trigger the electronic switching tube S7 to change state, the capacitor C32 connected with the electronic switching tube S7 turn to be charged by the voltage VCC, until a turn-off instruction enters to change state, the electronic switching tube S7 return an original state, the capacitor C32 discharges to the resistance R38 via the electronic switching tube S7 and sends out a turn-off signal F.

The delay circuit unit 33, composed of a resistance R36, a diode D32 and a capacitor C31, utilizes the capacitor C31 to charge to output the switch-on signal to the switch-on signal producing unit 35 delayedly, thereby avoiding producing a switch-on signal when the component for receiving the compulsive turn-off instruction is disabled.

The switch-on signal producing unit 35 is a simple switching circuit composed of an electronic switching tube S8 and a resistance R37. The switch-on signal producing unit 35 is triggered by the delayed switch-on instruction of the delay circuit unit 33 to produce a switch-on signal, thereby will not bring serious damage.

Further can provide a switch SW1 which can be switched on with the switch contact, the switch SW1 is connected between the voltage VCC and the first pin of J2A for preventing the present switch from stopping the other related interactive switch to be switched on, and supplying an auxiliary power supply for the other related circuit.

Above descriptions of the remote controlled interactive power switch of the present invention are used for assisting to understand the present invention, but the mode of execution of the present invention is not limited to the above-mentioned embodiments. Any change, modification, replacement, combination or simplification, which not deviates from the principle of the present invention, is an equivalent substitute mode, both of which are contained in the scope of protection of the present invention.

What is claimed is:

1. A remote controlled interactive power switch, comprising a first coil (L1) for controlling a switch contact to be closed by suction, a self-locked device (1) for locking the switch contact to keep conducting state by mechanical self-locking, a second coil (L2) for controlling the self-locked device (1) to be disengaged and a power supply control circuit which is connected with an interactive control module, the interactive control module comprising a remote controlled interactive connecting unit (40), an interactive monitoring unit (31), a switch-on signal producing unit (34) and a turn-off signal producing unit (35), wherein, the remote controlled interactive connecting unit (40) comprises a remote controlled receiving interface (HA) and an interactive monitoring interface (J2A); the remote controlled receiving interface (J1A) is provided for receiving an external remote controlled switch-on instruction or a turn-off instruction and outputting it to the interactive monitoring unit (31) via a photo-electric coupling circuit; the interactive monitoring interface (J2A) is provided for making a cross connection between the interactive monitoring unit (31) of the present power switch and an interactive monitoring interface (J2B) of a related remote controlled interactive power switch;

the interactive monitoring unit (31) is provided for outputting a compulsive turn-off instruction to an interactive monitoring unit of the related remote controlled interactive power switch after receiving the switch-on instruction produced by the remote controlled receiving interface (J1A) and instructing the turn-off signal producing unit (34) to output a turn-off signal after receiving a compulsive turn-off instruction produced by the interactive monitoring unit of the related remote controlled interactive power switch;

the switch-on signal producing unit (35) is provided for receiving a switch-on instruction and outputting a switch-on signal when the interactive monitoring unit (31) affirms that no compulsive turn-off instruction is existing; and the turn-off signal producing unit (34) is provided for emitting a turn-off signal in real time when receiving the turn-off instruction or compulsive turn-off instruction.

2. The remote controlled interactive power switch as claimed in claim 1, wherein the remote controlled receiving interface (J1A) is connected with a switch-on instruction detecting unit (30) via a photo-electric coupling circuit and outputs the switch-on instruction; the remote controlled receiving interface (J1A) is connected with the turn-off instruction detecting unit (34) via a photo-electric coupling circuit and outputs the turn-off instruction; the interactive monitoring unit (31) is connected with the interactive monitoring interface (J2A) via a photo-electric coupling circuit and receives the compulsive turn-off instruction.

3. The remote controlled interactive power switch as claimed in claim 2, wherein a delay circuit unit (33) is provided between the switch-on instruction detecting unit (30) and switch-on signal producing unit (35) for outputting signal to the switch-on signal producing unit (35) delayedly.

4. The remote controlled interactive power switch as claimed in claim 1, wherein a compulsive turn-off instruction output interface of the interactive monitoring unit (J2A) is connected with a switch (SW1) which can be switched on with the switch contact.

5. The remote controlled interactive power switch as claimed in claim 1, wherein the power supply control circuit further comprises:

an impulse direct-current source module (20), which is provided for converting alternating current source into impulse direct-current by a bridge rectifier and then outputting to the first coil (L1), second coil (L2) and other modules which need the power supply;

a first coil power supply control module, which is provided for producing a zero potential impulse wave according to the impulse direct-current voltage produced by the impulse direct-current source module (20), forming a monopulse switch-on signal when the switch-on signal is triggered at the next closest zero potential impulse, extracting pulsating current by the monopulse switch-on signal from the impulse direct-current source and outputting to the first coil (L1) to make the first coil (L1) produce a pulsed magnet field; and a second coil power supply control module, which is triggered by the turn-off signal to supply a pulse current for the second coil (L2).

6. The remote controlled interactive power switch as claimed in claim 5, wherein the first coil power supply control module comprises:

a zero potential impulse wave producing unit (21), which is provided for converting the zero potential of the entered impulse direct-current into high potential pulse signal by an electronic switching tube;

a monopulse switch-on instruction triggering unit (22), which is provided for outputting a monopulse switch-on signal when the switch-on signal is triggered at the next closest zero potential impulse; and a current producing unit (23), which is provided for supplying an access of the first coil (L1) and impulse direct-current source module (20) triggered by the monopulse switch-on signal.

7. The remote controlled interactive power switch as claimed in claim 5, wherein an outage automatic turn-off unit (24) is connected between the second coil power supply control module and impulse direct-current source module (20) for outputting a turn-off signal when the alternating current source is cut off.

8. The remote controlled interactive power switch as claimed in claim 2, wherein the switch-on instruction detecting unit (30) is further connected with a button switch (B1) for producing a switch-on instruction when the button switch (B1) is closed.

9. The remote controlled interactive power switch as claimed in claim 2, wherein a compulsive turn-off instruction output interface of the interactive monitoring unit (J2A) is connected with a switch (SW1) which can be switched on with the switch contact.

10. The remote controlled interactive power switch as claimed in claim 2, wherein the power supply control circuit further comprises:

an impulse direct-current source module (20), which is provided for converting alternating current source into impulse direct-current by a bridge rectifier and then outputting to the first coil (L1), second coil (L2) and other modules which need the power supply;

a first coil power supply control module, which is provided for producing a zero potential impulse wave according to the impulse direct-current voltage produced by the impulse direct-current source module (20), forming a monopulse switch-on signal when the switch-on signal is triggered at the next closest zero potential impulse, extracting pulsating current by the monopulse switch-on signal from the impulse direct-current source and outputting to the first coil (L1) to make the first coil (L1) produce a pulsed magnet field; and a second coil power supply control module, which is triggered by the turn-off signal to supply a pulse current for the second coil (L2).

11. The remote controlled interactive power switch as claimed in claim 3, wherein the power supply control circuit further comprises:

an impulse direct-current source module (20), which is provided for converting alternating current source into impulse direct-current by a bridge rectifier and then outputting to the first coil (L1), second coil (L2) and other modules which need the power supply;

a first coil power supply control module, which is provided for producing a zero potential impulse wave according to the impulse direct-current voltage produced by the impulse direct-current source module (20), forming a monopulse switch-on signal when the switch-on signal is triggered at the next closest zero potential impulse, extracting pulsating current by the monopulse switch-on signal from the impulse direct-current source and outputting to the first coil (L1) to make the first coil (L1) produce a pulsed magnet field; and a second coil power supply control module, which is triggered by the turn-off signal to supply a pulse current for the second coil (L2).

* * * * *